United States Patent [19]

Blasucci

[11] 4,206,452

[45] Jun. 3, 1980

[54] TENSION CORD BURGLAR-ALARM

[75] Inventor: Leonard Blasucci, Jersey City, N.J.

[73] Assignee: Fairway Trading, Inc., Jersey City, N.J.

[21] Appl. No.: 900,968

[22] Filed: Apr. 28, 1978

[51] Int. Cl.[2] ..... G08B 13/12; G08B 13/08; G08B 13/04

[52] U.S. Cl. ..... 340/548; 200/61.74; 200/61.93

[58] Field of Search ..... 340/548; 200/61.18, 200/61.74, 61.76, 61.93

[56] References Cited

U.S. PATENT DOCUMENTS

| | | | |
|---|---|---|---|
| 1,814,255 | 7/1931 | Loeding | 340/548 |
| 3,092,820 | 6/1963 | Garwick | 340/548 |
| 3,596,021 | 7/1971 | Saul | 200/61.93 |
| 3,877,909 | 6/1975 | Beiswenger et al. | 340/548 |

*Primary Examiner*—Glen R. Swann, III

*Attorney, Agent, or Firm*—Blum, Kaplan, Friedman, Silberman & Beran

[57] ABSTRACT

Members are attachable to the window or door around which a cord can be stretched, under tension, in the form of a polygon. A switch is positioned within the polygon, said switch being attached by further cords to two of the sides of the polygon. The switch is held under a selected tension and the shape of the polygon is such that an intruder cannot enter through the window or door without disturbing the cord polygon and, thereby, the tension on the switch. The switch is designed to respond to a change in the tension applied thereto, to supply a signal to an alarm system.

15 Claims, 6 Drawing Figures

FIG. 3
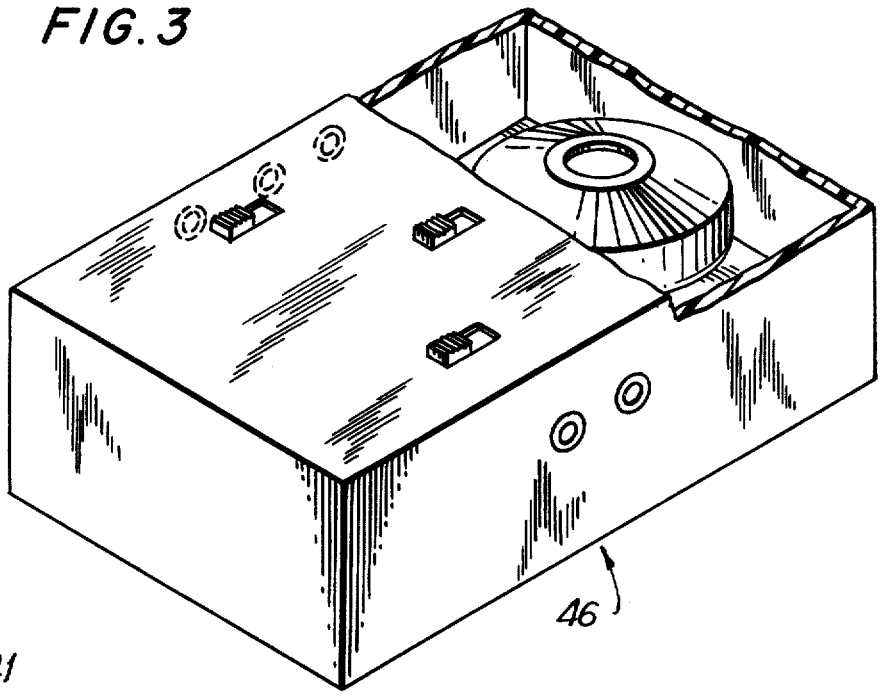
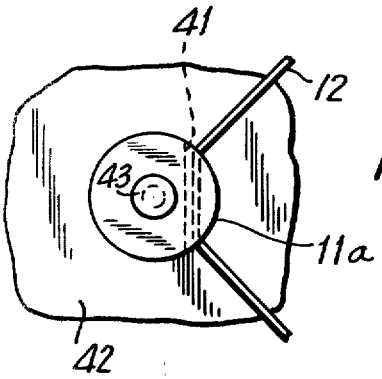
FIG. 2b
FIG. 4
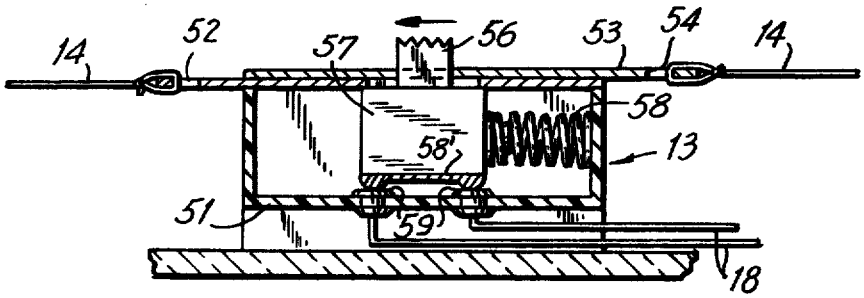

TENSION CORD BURGLAR-ALARM

BACKGROUND OF THE INVENTION

With the surge in the crime rate, in general, and particularly in the burglary rate, there has been a proliferation of protective devices, directed mostly toward prevention of illegal entry through doors. Bars and gratings of various types have been placed across windows but, in addition to being unsightly, these constitute a serious danger in that they may prevent rapid escape in the event of fire. Moreover, such bars and gratings are limited in application since they are essentially permanent fixtures; such bars and gratings, therefore, cannot be used for giving an alarm if an intruder attempts entry through a door or a window in a hotel room or a state room on a ship.

Somewhat the same problem arises with respect to sliding doors of the type where a single door slides into a wall or the double type where either of a pair of sliding doors can be moved past the other. Also, it would be desirable if such a device could be used in connection with both double hung windows and windows that open on a hinge.

While complete prevention of illegal entry by intruders provides the ultimate in protection, nevertheless, an effective alarm system which is portable, sufficiently inexpensive and easily applied can provide a measure of protection whether one is at home or travelling. As is evident, an inexpensive but effective device which is reliable, readily installed and easily portable is greatly to be desired.

SUMMARY OF THE INVENTION

A burglar-alarm device includes as an essential feature an off-on switch which can be altered with respect to being in an off state or an on state by a change in the tension applied thereto. To place the switch under tension, a plurality of cord holders are mounted on the door or window to be protected and a cord is used to connect the cord-holders. A switch, preferably of the slider type, is joined by the cord, the join being made in such a way that the switch is held under a selected tension. Change in tension of the switch can be used to cut off or initiate a current through said switch and thereby trigger an alarm. By the use of transistor circuitry the current required for operation can be held to a minimum so that the switch can be powered by small electrochemical cells as well as from the mains. Where the region to be protected is a double-hung window at least two of said cord-holders are attached to each section of the window. The cord-holders may be attached to the surface of the window or door by a suction cup or, where appropriate, by a push pin or other means. The cord holder can be provided with a groove therearound for receiving the cord or with an aperture through which the cord can be threaded.

In an exemplary embodiment at least four cord holders are provided and the cord attached thereto forms a polygon or loop. The switch is joined by two sides of the polygon by an additional cord. The dimensions of the polygon are such, that, in combination with the additional cord and switch, entry cannot be made through the window or door without disturbing the switch and the tension under which it is held.

The switch is preferably of the three-position type and spring-biased so that either an increase or decrease in tension will result in displacement of the switch from an intermediate position, displacement to either side position resulting in triggering of an alarm either by making or breaking a circuit.

It should be noted that the burglar-alarm device of the present invention is adaptable to protecting a hinge window or hinge door by placing at least two of the cord holders on an adjacent wall.

Accordingly, an object of the present invention is an improved burglar-alarm apparatus which is simple, of low cost, readily double-hunge or hinged.

A further object of the present invention is a burglar-alarm apparatus for triggering a signal when an attempt is made to enter through a window or door, whether by forcing said window or door or breaking same.

Another object of the present invention is a burglar-alarm apparatus which has an essential component a spring-biased switch which is mounted under tension and which is sensitive to any damage in the tension applied thereto, the mounting being such that any attempt to enter through a protected opening will result in changing the tension on said switch and thereby triggering a signal useful for producing an alarm.

An important object of the present invention is a burglar-alarm device employing a cord member which can be mounted in a form which makes allowance for the size and shape of an opening to be protected against an intruder so that the device cannot be avoided by the intruder.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2*b* is a plan view of a cord-holder in accordance with the present invention, said cord-holder being suited for fastening to a wall by means of a push pin;

FIG. 3 is a partial view in perspective of a monitor-alarm connectable to one or more burglar-alarm devices within the scope of the present invention for emitting an alarm on receipt of a signal from said burglar-alarm apparatus; and FIG. 4 is an elevational view, in section, through a tension-switch within the scope of the present invention.

DETAILED DESCRIPTION OF THE PREFERRED EMBODIMENTS

Figure 1A:
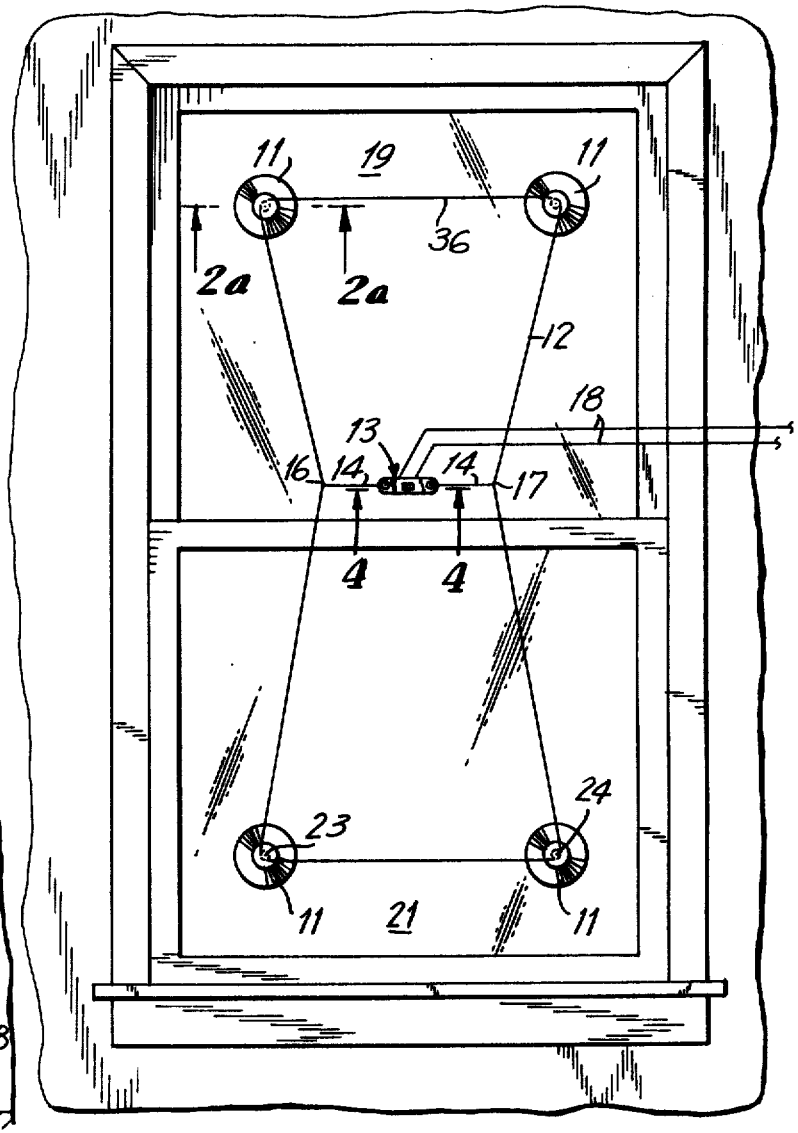
FIG. 1*a* is an elevational view of a double-hung window fitted with the burglar-alarm device of the present invention.

The burglar-alarm apparatus of the present invention, as illustrated in FIG. 1*a*, includes four cord holders 11 joined by a cord 12 in the form of a polygon or loop.

Preferably, the loop is endless. The cord 12 is mounted upon the cord holders so that it can slide freely. A switch 13 is positioned inside the polygon formed by the loop 12. Switch 13 is a tension switch, this designation indicating that it may be held under tension and that any substantial change in the tension applied to said switch will change it from the open to the closed position or vice versa, depending upon how it is connected. The switch is held in tension by cord sections 14 which may be joined respectively to appropriate portions of the switch. Cord sections 14 are joined to two sides of the polygon formed by cord 12 at points 16 and 17. Joining the cord sections 14 to cord 12 so that the cord sections 14 and switch 13 are under tension deforms the sides of the polygon so that what was originally a four-sided figure becomes an irregular hexagon with two re-entrant angles at points 16 and 17. Switch 13 is connectable by leads 18 to an external alarm system which, if desired, may be so constructed that it can monitor a plurality of such burglar-alarm devices.

Figure 2A:
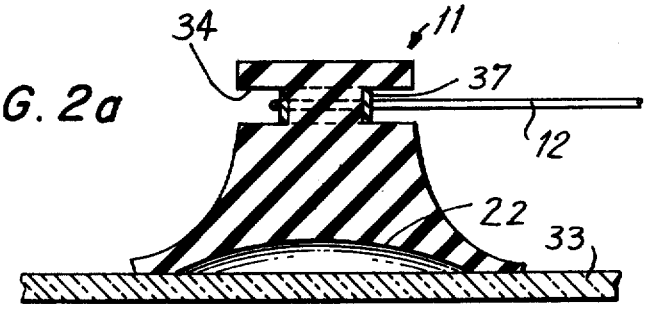
FIG. 2*a* is a view of the cord-holder within the scope of the present invention, said view being taken along line 2*a*—2*a* of FIG. 1*a*.

Cord holders 11 may be attached to the interior surfaces of upper and lower windows 19 and 21. Attachment is preferably by way of a suction cup configuration 22, as shown in FIG. 2*a*. However, other means of attachment may be used as a layer of a pressure-sensitive adhesive, for instance.

In the positioning of the cord holders 11 against the window panes or other closure to be protected against an intruder, the cord holders 11 are so disposed that entry cannot be effected through the closure without changing the tension applied to switch 13 by cord sections 14. Thus, if window section 19 is lowered, the tension in loop 12 will be decreased, producing a reduction in tension in the cord members 14 and in switch 13, thereby changing the state of the switch and the current through leads 18 to activate an alarm. Furthermore, a trapezoidal loop of cord having the apices 16, 17, 23 and 24 is of such a size and shape that an intruder cannot cut out a section of glass and enter through the trapezoid without disturbing the cord and thereby activating an alarm. Similarly, the spaces outside the loop are of such a size that an intruder cannot penetrate between the window frame or sash and the cord. The same, of course, applies to the trapezoidal loop positioned on the upper window section 19.

Figure 1B:
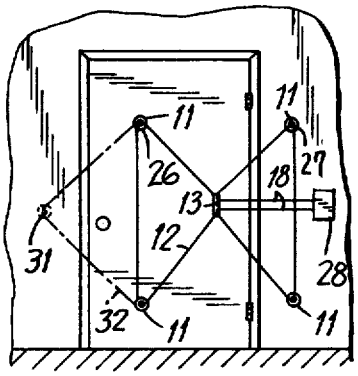
FIG. 1*b* is an elevational view in partial section of a door fitted with an embodiment of the present invention for protection against entry by an intruder.

The arrangement of the cords, switch and cord holders, as shown in FIG. 1*a*, can readily be adapted for sliding door, it merely being necessary to rotate the figure through 90°. The apparatus is also suitable for protecting a hinged window or door against entry therethrough by an intruder, a suitable arrangement being shown in FIG. 1*b*, like reference numerals being utilized to denote like elements depicted above. Specifically, the switch is mounted vertically rather than horizontally. It will be noted that the cord 12, as indicated by the solid line, passes over the hinged section of the door but not over the gap formed by the door when it is opened. Nevertheless, opening the door brings point 26 closer to point 27 thereby decreasing the tension on switch 13 and initiating a signal to monitor-alarm 28. If desired, however, the cord can be arranged so that it passes over the gap formed when the door is opened, disposition of the cord in this manner being indicated by the dashed line 32 passing over cord holder 31.

A preferred cord holder, indicated generally by the reference numeral 11, is shown in FIG. 2*a*, said cord holder being made of a flexible rubber, preferably, and having a cup-shaped section 22 at the base thereof for making contact with and holding to a smooth surface 33 which may be a pane of glass or metal or enamelled metal or porcelain or the like. In the embodiment of FIG. 2*a* a groove 34 around the body of the cord holder 11 is provided. The cord 12 is looped around cord holder 11 in this channel 34 in which it must be held slideably. It is essential that the cord be held with a relatively low degree of friction since, otherwise, a change in the tension at a location such as that indicated by the reference numeral 36 in FIG. 1*a* will not be transmitted to the cord sections 14 and, thence, to the switch 13. The channel may be lubricated, if desired, in order to improve the slideability of the cord 12 in the channel 34. Other expedients may also be employed, an example being a collar 37. The cord member 12 can be held by the cord holders in other ways such as by means of small pulleys (not shown) or an aperture or loop through which the cord may be threaded. Such an arrangement is shown in FIG. 2*b* in which a cord 12 is threaded through an aperture 41 in a cord holder 11*a*. In the embodiment of FIG. 2*b*, the cord holder 11*a* is held to a wall 42 by means of a push pin or nail 43.

As aforenoted, leads 18 carry a signal to a monitor-alarm, such a monitor-alarm being shown in FIG. 3 and having the reference numeral 46. The monitor-alarm 46 is essentially of conventional structure and operable either by alternating current or by small dry cells. The monitor-alarm can be constructed to receive signals from one or from a plurality of burglar-alarms in accordance with the present invention. Selectivity can be provided by means of appropriate external switches which also provide for turning the device off and for resetting after a disturbance.

While a two-position switch can serve, a three-position switch is strongly preferred since such a switch can be mounted so that it can detect and be activated by either an increase or a decrease in the tension applied thereto. The construction of such a switch is shown in FIG. 4, the switch being generally indicated by the reference numeral 13 being shown in partial section and in somewhat enlarged scale in FIG. 4.

Tension switch 13 includes a body 51 having an aperture 52 conveniently located for attachment to one of the cord members 14 and having a slider 53 also having an aperture 54 therethrough for attachment to the other cord member 14. Slider 53 links with projection 56 of switch arm 57. Placing the cord members 14 under tension with respect to each other pulls the switch body 51 and the slider 53 in opposite directions, moving the switch arm to the right, as represented in FIG. 4, against the biasing action of spring 58. The tension in the cord members 14 can be adjusted by the positioning of cord holders 11 on the closure to be protected. The tension lies in the appropriate range when the conductive portion 58' bridges the two contacts 59, thereby completing the circuit through the leads 18.

Preferably, the monitor-alarm 46 is so constructed that when the two leads 18 are connected with each other the alarm does not sound. Breaking the circuit by moving the switch arm to one side or the other through an increase or decrease in tension in cords sections 14 causes the alarm to sound. In setting up the burglar-alarm device, it is convenient that the monitor-alarm should be constructed to indicate by means of a signal light or a low level sound when the switch is in the correct position. Alternatively, the exterior of the switch can be marked to show when the projection 56 is properly located.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which as a matter of language, might be said to fall therebetween.

What is claimed is:

1. A burglar-alarm apparatus for use with a closure means having two sections moveable with respect to each other comprising in combination switch means positionable under tension and adapted to be operated and produce an alarm signal in response to a change of tension applied thereto, first attachment means adapted to be secured to a first section of said closure means and second attachment means adapted to be secured to a second section of said closure means, and cord means for coupling said switch means under tension to said first and second attachment means to position said switch means without its being fixedly secured to the first section or the second section, so that a signal is produced when said first and second sections of said closure means are moved with respect to each other.

2. A burglar-alarm apparatus as claimed in claim 1, wherein said first attachment means includes at least two support members adapted to be secured releaseably to said first section of said closure means.

3. A burglar-alarm apparatus as claimed in claim 2, wherein said second attachment means includes at least two support members adapted to be releaseably secured to said second section of said closure means.

4. A burglar-alarm apparatus as claimed in claim 3, wherein said cord means includes a first cord member coupled under tension to said four support members in the form of a polygon, and a second cord member for coupling said switch means under a predetermined level of tension to at least two sides of said polygon formed by said first cord member so that said switch is operated in response to a change in said predetermined level of tension.

5. A burglar-alarm apparatus for detecting and signalling the breakage or unwanted opening of a section of a closure means having two or more sections, each section of said closure means having an inner face with respect to an enclosure, said apparatus comprising a first cord member, at least four attachment means readily attachable to and releasable from said inner face of said two sections, each of said attachment means including cord-receiving means for slideably holding said first cord member under tension in the form of a polygon when at least two of said at least four attachment means are joined to the inner face of each of two sections of a closure means, switch means positionable under tension within said polygon, said switch means being operable by change in tension applied thereto for providing a signal and a second cord member attachable at a selected tension level to two sides of said polygon formed by said first cord member and to said switch means for moving said switch from one to the other of an open state and a closed state in the event that the tension in said second cord member is changed from said selected level as the result of opening or breaking a section of said closure means.

6. A burglar-alarm apparatus as claimed in claim 5, further comprising a voltage source and an alarm means operatively connected with said switch means.

7. A burglar-alarm apparatus as claimed in claim 5, wherein said switch means is of the normally open 3-position type so that displacement in either of two opposed directions can open a circuit.

8. A burglar-alarm apparatus as claimed in claim 7, wherein said switch means is a sliding switch.

9. A burglar-alarm apparatus as claimed in claim 5, wherein said attachment means includes suction cup means for holding same to said inner face.

10. A burglar-alarm apparatus as claimed in claim 5, wherein said cord-receiving means is a channel around said attachment means.

11. A burglar-alarm apparatus as claimed in claim 5, wherein said two sides of said polygon attached to said second cord member are non-adjacent.

12. A burglar-alarm apparatus as claimed in claim 5, wherein the number of attachment means is four, and said second cord member and said switch means are positioned under tension between non-contiguous sides of said polygon.

13. A burglar-alarm apparatus as claimed in claim 5, wherein said switch means includes spring means biasing said switch from a closed state to an open state.

14. A burglar-alarm apparatus as claimed in claim 13, wherein said switch means includes a body portion and a slide portion and said second cord member is in two segments, one of said segments being attached to said body portion, the other being attached to said slide portion.

15. An apparatus for detecting and signalling the breakage or opening of a hinged window or door closure means or a sliding window or door closure means, each closure means having an inner face with respect to an enclosure and being adjacent a portion of a wall, said device comprising a first cord member, at least four attachment means readily attachable to and releasable from the inner face of said closure means and attachable to said adjacent portion of said wall, each of said attachment means including cord-receiving means for slideably holding said first cord member under tension in the form of a polygon when at least two of said at least four attachment means are attached to said inner face of said closure means and at least two are attached to said adjacent wall, switch means for positioning under tension within said polygon, said switch means being operable by a change in tension applied thereto and a second cord member attachable at a selected tension level to two sides of said polygon formed by said first cord member and to said switch means for moving said switch means from one to the other of an open state and a closed state in the event that the tension in said second cord member is changed from said selected level as the result of opening or breaking said closure means.

* * * * *